US005624503A

United States Patent [19]

Yamashita

[11] Patent Number: 5,624,503

[45] Date of Patent: Apr. 29, 1997

[54] PROCESS FOR PRODUCING ND-FE-B MAGNET

[75] Inventor: Fumitoshi Yamashita, Ikoma, Japan

[73] Assignee: Matsushita Electric Industrial Co., Ltd., Tokyo, Japan

[21] Appl. No.: 563,355

[22] Filed: Nov. 28, 1995

Related U.S. Application Data

[63] Continuation of Ser. No. 163,721, Dec. 9, 1993, abandoned.

[30] Foreign Application Priority Data

Dec. 24, 1992 [JP] Japan ..... 4-343943
Mar. 9, 1993 [JP] Japan ..... 5-047689

[51] Int. Cl.[6] ..... H01F 41/02

[52] U.S. Cl. ..... 148/103; 148/104

[58] Field of Search ..... 148/101, 103, 148/104

[56] References Cited

U.S. PATENT DOCUMENTS

| | | | |
|---|---|---|---|
| 4,689,163 | 8/1987 | Yamashita et al. | 252/62.54 |
| 4,898,625 | 2/1990 | Otsuka et al. | 138/104 |
| 4,981,635 | 1/1991 | Yamashita et al. | 264/112 |
| 5,100,485 | 3/1992 | Yamashita et al. | 148/101 |
| 5,100,604 | 3/1992 | Yamashita et al. | 264/115 |
| 5,178,692 | 1/1993 | Panchanathan | 148/101 |
| 5,201,962 | 4/1993 | Yamashita et al. | 138/101 |

FOREIGN PATENT DOCUMENTS

| | | | |
|---|---|---|---|
| 4021990 | 1/1991 | Germany | 148/101 |

OTHER PUBLICATIONS

Lee et al, "Processing of Neodymium–Iron–Boron Melt–Spun Ribbons To Fully Dense Magnets", IEEE Transactions on Magnetics, vol. Mag–21, No. 5, pp. 1958–1963, Sep. 1985.

Herbst, et al, "Rare Earth–Iron–Boron Materials: A new Era in Permanent Magnets", Ann. Rev. Mater. Sci., pp. 467–484, 1986.

Doser, et al, "Pulverizing Anisotropic Rapidly Solidified Nd–Fe–B Materials for Bonded Magnets", J. Appl. Phys., 70(10), pp. 6603–6605, Nov. 1991.

Mukai, et al, "Fully–Dense Nd–Fe–B Magnets Prepared From Hot–Rolled Anisotropic Powders", 5th Joint MMM–Intermag Conference, Jun. 18–21, 1991.

Nakayama, et al, "Magnetic Properties and Microstructures of the Nd–Fe–B Magnet Powder Produced by Hydrogen Treatment", J. Appl. Phys., 70(7), pp. 3770–3774, Oct. 1991.

*Primary Examiner*—John Sheehan

*Attorney, Agent, or Firm*—Watson Cole Stevens Davis, P.L.L.C.

[57] ABSTRACT

A process for producing a magnet in which the content of anisotropic magnet powder is from 95 to 50% by weight. The process includes the following steps. A powder mixture composed of the anisotropic magnet powder and solder powder containing isotropic magnet powder as a main constituent thereof is charged in a compacting mold. The powder mixture in a cavity is orientated in a magnetic field. It is compressed and Joule heated. Thus, the powder mixture is fixed. When the powder mixture is fixed into a magnet, the ratio (Po/Lo) of the average grain size Po of the anisotropic magnet powder to the size of the magnet Lo which size is measured in the orientation direction is preferably 0.6 or more.

8 Claims, 2 Drawing Sheets

PROCESS FOR PRODUCING ND-FE-B MAGNET

This application is a continuation of application Ser. No. 08/163,721, filed Dec. 9, 1993 (abandoned).

BACKGROUND OF THE INVENTION

1. Field of the Invention

The present invention relates to a process for producing a Nd-Fe-B magnet in which the powder mixture mainly composed of anisotropic Nd-Fe-B magnet powder (hereinafter referred to as anisotropic magnet powder) and isotropic Nd-Fe-B magnet powder (hereinafter referred to as isotropic magnet powder) is compressed and heated by current supply so as to be fixed to a specific configuration.

2. Description of the Related Art

Conventionally, isotropic magnet powder can be obtained by the following process. Molten alloy having (Nd/Pr):(Fe/Co):B ratio of approximately 2:14:1 is melt-spun and suitably heat-treated at a temperature of not less than the crystallization temperature, as disclosed in, for example, "Producing of Neodymium-Iron-Boron Melt-Spun Ribbons to Fully Dense Magnet" IEEE T. MAG. Vol. MAG-21, No. 5 (1985) by R. W. Lee, et al. and "Rare Earth-Iron-Boron Materials; A New Era in Permanent Magnets" Ann. Rev. Sci. Vol. 16 (1986) by J. F. Herbest. In the isotropic magnet powder there occurs such fine structure that $Nd_2Fe_{14}B$ phase with a size approximately from 20 to 200 nm is dispersed at random in an amorphous Fe phase, thereby developing the coercive force (Hcj).

The state of a material obtained by the above melt-spinning is restricted to a powder. No matter what kind of method is used, in order to obtain a magnet of a specific configuration generally used, a technique is required to fix the isotropic magnet powder into a specific configuration. In the field of powder metallurgy, sintering under an atmospheric pressure is a basic technique for fixing a powder. Since it is necessary to heat the powder at a far higher temperature than the crystallization temperature in this method, the $Nd_2Fe_{14}B$ phase is excessively grown, thus reducing the coercive force (Hcj).

In order to overcome the above drawback, as disclosed in, for example, U.S. Pat. Nos. 4,689,163, 4,981,635 and 5,100,604, isotropic magnet powder is fixed to a specific configuration by generally using a different kind of material, for example, a resin. The obtained magnet has been developed and put into practice. The magnet fixed by such a resin has a maximum energy product (BH)max of up to 9 MGOe.

When the isotropic magnet powder is hot die-up-setting worked, as disclosed in the theses by R. W. Lee and J. F. Herbest, the crystal orientation of the $Nd_2Fe_{14}B$ phase is changed, thereby showing remarkable anisotropic characteristics and thus reaching the (BH)max of up to 40 MGOe. However, in the hot die-up-setting method, it is difficult to directly obtain a specifically-configured magnet in which the practical near-net-shape is ensured. It is also difficult to grind the magnet.

In view of this background, an applied technique has been developed and examined as follows. As disclosed in, for example, "Pulverizing Anisotropic Rapidly Solidified Nd-Fe-B Materials for Bonded Magnet" J. Appl. Phys. 70(10), 15(1991) by M. Doser, V. Panchnathan, after the isotropic magnet powder is hot die-up-setting worked, it is pulverized so as to produce anisotropic magnet powder which is orientated in a magnetic field and then fixed by a different kind of material, such as a resin. The resultant magnet has a (BH)max of about 15 MGOe higher than a magnet obtained by fixing isotropic magnet powder by a resin.

In order to target a high (BH)max for the magnet obtained by fixing the anisotropic magnet powder by a different kind of material, the anisotropic magnet powder is required to possess both strong anisotropic characteristics and high (BH)max. It is also important to obtain a technique of fixing the anisotropic magnet powder with the particular orientation while maintaining the orientation and compressing a mass of the powder to reduce gaps, thus increasing the volume fraction of the anisotropic magnet powder in the magnet.

It is relatively easy to magnetically orientate the anisotropic magnet powder by use of a magnetic field. However, in general, it is necessary to compress the anisotropic magnet powder with high stress, for example, a few tons/$cm^2$ at approximately room temperature with a view to increasing the volume fraction of the anisotropic magnet powder in the specifically-configured magnet. The anisotropic magnet powder has great inter-grain friction when it is compressed at room temperature, and thus, it is partially destroyed when it is displaced to fill gaps and when it becomes densely-packed. The coercive force Hcj of the anisotropic magnet powder greatly depends on the grain size; for example, the fine powder with a grain size of 50 μm or less lowers Hcj. Also, the magnet powder destroyed by compression disturbs the orientation, thus failing to obtain a high (BH)max. Further, the volume fraction of the anisotropic magnet powder in the magnet is limited to approximately 80 vol %. As will be seen from the above problems, such technique is coming to be greatly demanded that, while the anisotropic magnet powder is densely packed, the damage of the powder is minimized to suppress the disturbance of the orientation and the volume fraction of the anisotropic magnet powder in the magnet is made to be increased.

SUMMARY OF THE INVENTION

Accordingly, the present invention relates to a process for producing magnet comprising anisotropic magnetic powder as a main constituent thereof, and an object of the present invention is to provide a method of producing a specifically-configured magnet having a high (BH)max in which the anisotropic magnet powder can be densely packed without any substantial damage thereto and without disturbing the orientation thereof and in which the volume fraction of the magnet powder can be increased.

In order to achieve the above object, the present invention provides a process for producing a magnet in which the content of an isotropic magnet powder is from 95 to 50% by weight, the process comprising the steps of: filling a compacting mold with a powder mixture composed of the anisotropic magnet powder and solder powder containing isotropic magnet powder as a main constituent thereof; magnetically orientating the powder mixture in a cavity of the compacting mold in a magnetic field; and compressing and Joule heating the magnetic powder mixture, thereby fixing it.

Further, when the powder mixture is fixed into a magnet, the ratio (Po/Lo) of the average particle size Po of the anisotropic magnet powder to the size Lo of the magnet which size is measured in the magnetical orientation (magnetization) direction is preferably 0.6 or more.

The powder mixture filled in the compacting mold is heated to the crystallization temperature or higher by Joule heating while being compressed with a stress from 250 to 300 kgf/cm$^2$, whereby it becomes possible to minimize the damage of the anisotropic magnet powder to thereby prevent the magnetic orientation thereof from being disturbed while increasing the volume fraction of the magnet powder. Hence, a specifically-configured magnet having a high (BH) max can be obtained.

The magnet components in the powder mixture magnetized in a magnetic field are thermally demagnetized, and thus, the produced magnet can be treated easily.

DESCRIPTION OF THE PREFERRED EMBODIMENTS

Figure 1:
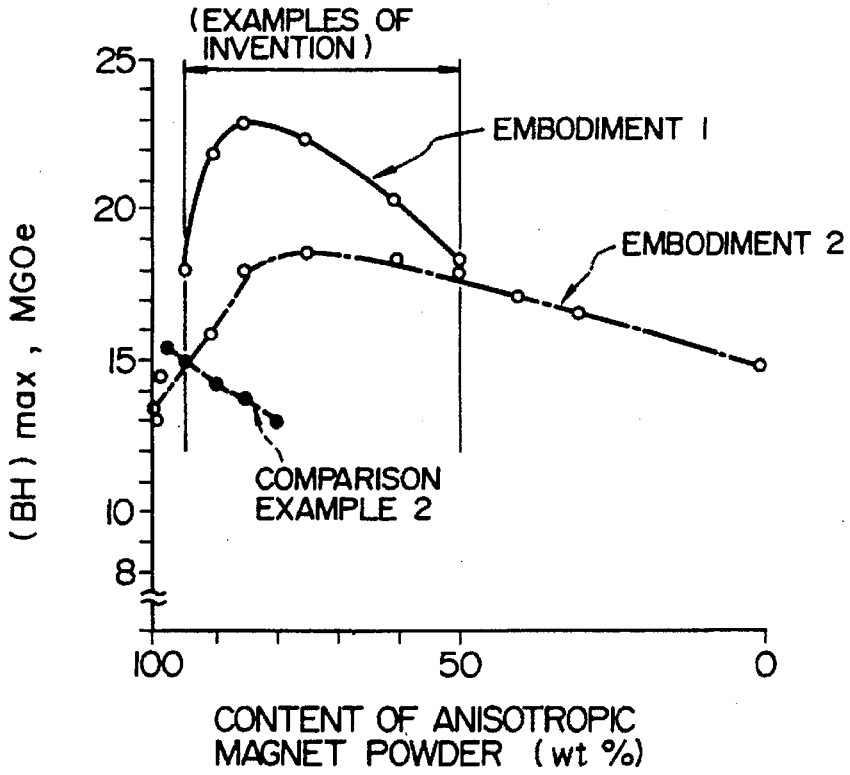
FIG. 1 is a graph showing the relationship between the (BH)max and the content (% by weight) of anisotropic magnet powder.

The present invention will be described in more detail.

A description will first be given of a powder mixture comprising 95 to 50% by weight anisotropic magnet powder and solder powder different thereto containing isotropic magnet powder as a main constituent thereof, the powder mixture forming the magnet of the present invention.

The anisotropic magnet powder used in the present invention may be, for example, hot-worked powder disclosed in "Pulverizing Anisotropic Rapidly Solidified Nd-Fe-B Materials for Bonded Magnet" J. Appl. Phys. 70(10), 15(1991) by M. Doser, V. Panchnathan or "Fully-Dense Nd-Fe-B Magnets Prepared from Hot-Rolled Anisotropic Powders" 5th joint MMM-intermag Conference, Jun. 18–21 (1991) by T. Mukai, et al., or hydrogen-decomposed/recrystallized powder disclosed in "Magnetic Properties and Microstructures of the Nd-Fe-B Magnet Powder Produced by Hydrogen Treatment" J. Appl. Phys. 70(7) (1991) by T. Takeshita, et al.

In the solder powder, the isotropic magnet powder used as a main constituent thereof may be, for example, isotropic magnet powder disclosed in "Producing of Neodymium-Iron-Boron Melt-Spun Ribbons to Fully Dense Magnet" IEEE T. MAG. Vol. MAG-21, No.5 (1985) by R. W. Lee, et al. or "Rare Earth-Iron-Boron Materials; A New Era in Permanent Magnets" Ann. Rev. Sci. Vol. 16 (1986) by J. F. Herbest. It is preferable for the solder powder to contain a solder which softens/melts when it is compressively heated, such as a small amount of at least one kind selected from the group consisting of Cd-Zn, Pb-Sb, Sn-In, Cd-In, Bi-Pb, Bi-Sn, boro-silicate glass, alumino boro-silicate glass, and low-melting glass containing MgO, ZrO, PbO, BaO, CaO, and the like.

When the above solder is used together with the isotropic magnet powder, it improves slip properties of the anisotropic magnet powder when it is displaced by compression so as to fill gaps, thereby effectively preventing the magnetic orientation from being disturbed. Also, when the isotropic magnet powder intervenes among the anisotropic magnet powders, the volume fraction of the overall magnet powder can be increased so far as such a range is concerned that the magnetic orientation of the anisotropic magnet powder is not considerably disturbed. The content of the anisotropic magnet powder in the magnet is from 95 to 50% by weight in order to obtain a high (BH) max magnet. Preferably, the ratio (Po/Lo) of the average particle size Po of the anisotropic magnet powder to the size Lo of the magnet which size is measured in the magnetic orientation direction is not less than 0.6. If the ratio (Po/Lo) is less than 0.6, the relative displacement of the anisotropic magnet powder is increased to disturb the magnetic orientation (magnetization) when the anisotropic magnet powder is compressed to be a magnet.

A process for fixing the above mixture powder in the compacting mold will be explained.

The process for fixing the isotropic magnet powder by both direct Joule heating and compressing is suitable for obtaining, at low pressure and within a short period of time, a specifically-configured magnet in which the practical near-net-shape can be ensured in the compacting mold, as disclosed in the U.S. Pat. No. 5,100,485. Some respects in the process of the present invention follow such a process.

In the present invention, the powder mixture being dry-mixed in the V-type mixer, or the like, is charged in a compacting mold and is magnetically orientated in a pulse or continuous magnetic field, or in both fields superimposed on each other. The magnetic field strength is preferably 15 kOe or more in order to enhance the magnetic orientation, and the compression stress is preferably is such a range of 250 kg/cm$^2$ or less that the magnet powder is not mechanically damaged.

The powder mixture orientated in the compacting mold is current-supplied in a pulsating manner while being compressed at a pressure similar to that when the powder mixture is magnetically orientated so as to ensure uniform current-supply to the powder mixture. It should be noted that, in such an initial stage that current supply is directly effected through the powder mixture while compressing the powder mixture, the application of the magnetic field may be overlapped with the heating.

Subsequently, the powder mixture magnetically orientated in the compacting mold is supplied with current while being compressed at a pressure similar to that applied at the step of magnetically when the powder orientating the powder mixture, so that the powder mixture is heated by Joule heat. The crystallization temperature of the powder mixture is approximately 590 ° C. and the Curie temperature thereof is generally lower than the crystallization temperature by 120° C. or more although it depends upon the content of Co substituting for a part of Fe. Thus, when the temperature of the powder mixture exceeds the Curie temperature, the powder mixture is thermally demagnetized so as to lose its magnetic orientation. However, until the temperature of the powder mixture exceeds the crystallization temperature, the powder mixture can be prevented from being damaged due to compressive pressure and from being displaced excessively.

When the temperature of the powder mixture exceeds the crystallization temperature of the magnet powder contained in the powder mixture, the anisotropic magnet powder begins to move in the compacting mold. However, the powder mixture is unlikely to be damaged during the movement because slip properties of both the molten solder and the anisotropic magnet powder are improved. Also, the isotropic magnet powder itself is deformed to minimize the disturbance of magnetic orientation which disturbance occurs due to excessively densely-packed anisotropic magnet powder.

In particular, when the ratio (Po/Lo) of the average particle size Po of the anisotropic magnet powder to the size Lo of the magnet which size is measured in the orientation direction exceeds 0.6, the relative displacement of the anisotropic magnet powder becomes small, thus minimizing the disturbance of magnetic orientation to thereby produce a magnet having the highest (BH) max.

A description will now be given of embodiments of the present invention.

EXAMPLE 1

Figure 3A:
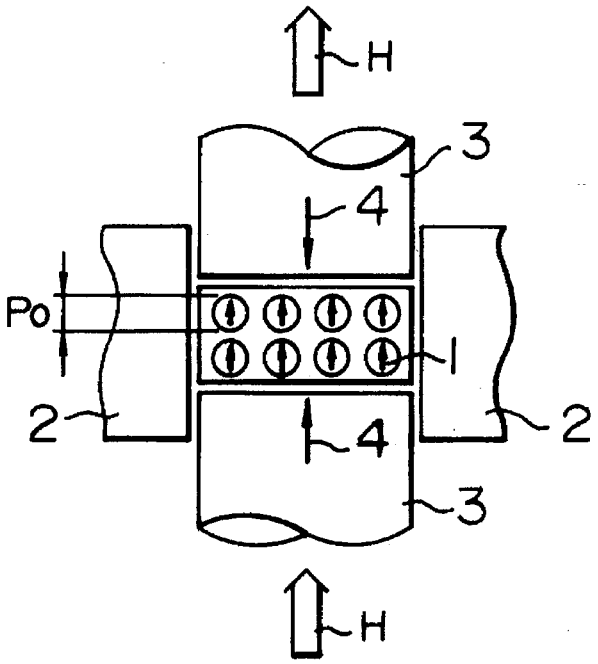
FIG. 3A is a schematic view showing a step of magnetically orientating mixed powder.

Both isotropic magnet powder with a particle size of 50 to 250 μm having an alloy composition of $Nd_{13.5}Fe_{62.5}Co_{18}B_6$ and solder powder of a kind different from the isotropic magnet powder which solder powder comprises Ag-Cu-Zn-Cd-Ni powder having a liquidus temperature of approximately 620° C. were mixed in the V-type mixer at a weight ratio of 97:3 to thereby prepare solder powder. Anisotropic magnet powder 1 of an alloy composition of $Nd_{13.9}Fe_{77.5}Co_{2.60}B_{6.00}$ having a particle size Po of 50–250 μm was further added to the solder powder in the V-type mixer to thereby prepare powder mixture. The resultant powder mixture was charged, as shown in FIG. 3A, in the compacting mold formed of an insulating sialon die 2 and conductive TiN/sialon electrodes 3 and then was compression-molded with a stress 4 of 250 kg/cm$^2$ in a pulse magnetic field (H) of 25 kOe parallel to the compression axis so that the mixture was magnetically orientated in the compression direction.

Figure 3B:
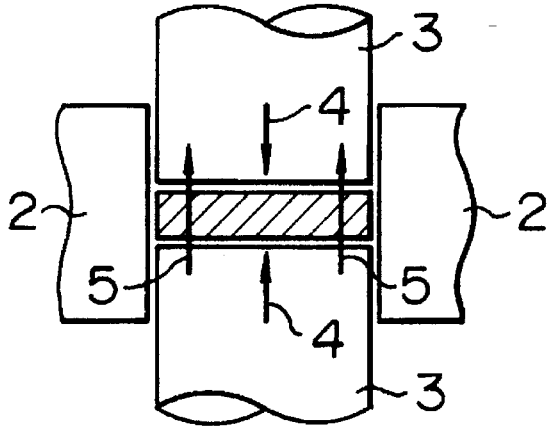
FIG. 3B is a schematic view showing a step of compressing the orientated mixed powder and feeding current through the mixed powder.
Figure 3C:
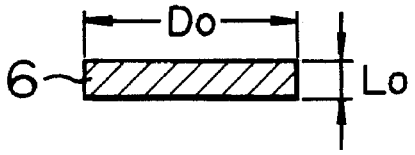
FIG. 3C is a sectional view of a magnet.

Subsequently, as shown in FIG. 3B, the powder mixture was supplied with current in a pulsating manner (ON:250A, 50 ms/OFF:50 ms) for 10 seconds while being compressed with a stress 4 of 250 kgf/cm$^2$ to thereby ensure uniform current-supply to the powder mixture. Then, the powder mixture was heated and further compressed while a current 5 of 300 to 350 A/cm$^2$ was directly supplied for 20 to 30 seconds to the powder mixture, until it reached a maximum temperature from 700° to 780° C. As a result, as shown in FIG. 3C, a magnet 6 with a density from 7.5 to 7.6 g/cm$^3$ having a diameter Do of 12 mm and a thickness Lo of 1 mm was obtained. 8 pieces of such a magnet 6 were laminated and magnetized in a pulse magnetic field of 50 kOe. The maximum value of (BH)max of the resultant product was 23.0 MGOe.

EXAMPLE 2

Isotropic magnet powder and anisotropic magnet powder were mixed without Ag-Cu-Zn-Cd-Ni powder. The resultant mixture was heated and compressed under the same conditions as those in Example 1 to thereby obtain a magnet with a density from 7.5 to 7.6 g/cm$^3$ having a diameter Do of 12 mm and a thickness Lo of 1 mm. 8 pieces of such a magnet were laminated and magnetized in a pulse magnetic field of 50 kOe. The maximum value of (BH)max of the resultant product was 18.6 MGOe.

Comparative Example 1

A silicon resin-mixed powder was obtained by mixing silicon resin powder having a particle size from 10 to 50 μm with the same anisotropic magnet powder as that in Example 1 in order to improve slip properties. The silicon resin-mixed powder and an epoxy resin were further mixed at the ratio of 97:3. Then, the resultant powder mixture was charged in the compacting mold and was compression-molded with a stress of 6000 kgf/cm$^2$ for 10 seconds in a pulse magnetic field of 25 kOe superimposed on a continuous magnetic field of 10 kOe parallel to the compression axis so that the mixture was magnetically orientated in a compression direction. Subsequently, the powder mixture was demagnetized by an electric current. The compressed powder mixture was removed from the mold and heated for 1 h at a temperature of 120° C. so as to cure the epoxy resin and thus to obtain a magnet with a density from 5.9 to 6.3 g/cm$^3$ having a diameter of 12 mm and a thickness of 1 mm. 8 pieces of such a magnet were laminated and magnetized in a pulse magnetic field of 50 kOe. The maximum value of (BH)max of the resultant product was 15.5 MGOe.

FIG. 1 shows the relationship between the (BH) max of the magnets obtained in Examples 1, 2 and the Comparative Example 1 after being magnetized at the pulse magnetic field of 50 kOe and the content (% by weight) of the anisotropic magnet powders in the magnets.

The magnet in Comparative Example 1 is fixed by a different kind of material such as a resin by compressing the anisotropic magnet powder at room temperature. Although slip properties of the anisotropic magnet powder during the displacement are improved, a considerable amount of gaps still remains in such a magnet. Thus, the (BH) max of the magnet is at most 15.5 MGOe.

In Example 2, in a case where 100 weight % anisotropic Nd-Fe-B magnet powder was used and was heated while being compressed to thereby produce a magnet with a density of 7.5 to 7.6 g/cm$^3$, the orientation of the magnet was disturbed due to the excessively densely-packed anisotropic magnet powder. Thus, the (BH)max of the resultant magnet was at most 13.5 MGOe. In order to overcome the above drawback, as in Example 2, isotropic magnet powder was mixed with the magnet powder, which mixture was heated and compressed. In this case, the isotropic magnet powder acted to prevent the anisotropic magnet powder from being excessively densified, with the result that the (BH)max of the resultant magnet is improved to a maximum of 18.6 MGOe.

Further, as in Example 1, in a case where solder powder containing isotropic magnet powder as a main constituent thereof is mixed with the anisotropic magnet powder, the solder powder first improves the slip properties of the anisotropic magnet powder during the movement thereof, and then, the isotropic magnet powder minimizes the disturbance of orientation which disturbance occurs due to excessive densification of the anisotropic magnet powder. Therefore, the (BH)max of the resultant magnet is improved to a maximum of 23 MGOe. If the content of the anisotropic magnet powder in the magnet is 95% by weight or more, it is impossible to obtain the effect of minimizing the disturbance of the magnetic orientation. On the other hand, if such a content is 50% by weight or less, slip properties of the anisotropic magnet powder during the movement thereof cannot be improved.

EXAMPLE 3

Isotropic magnet powder with a grain size from 50 to 250 μm having an alloy composition of $Nd_{13.5}Fe_{62.5}Co_{18}B_6$ was mixed with a solder powder of glass powder with a particle size from 10 to 50 μm having a low melting point of approximately 580° C. at the weight ratio of 97:3 to thereby prepare solder powder, which solder powder of 15% by weight was then mixed with 85 weight % anisotropic magnet powder with a particle size of 50 to 250 μm having an alloy composition of $Nd_{13.0}Fe_{80.0}B_6Ga_1$ in the V-type mixer. The resultant powder mixture was heated while being compressed under the same conditions as those in Example 1 so as to obtain a magnet with a density from 7.5 to 7.6 g/cm$^3$ having a diameter of 12 mm and a thickness of 1 mm. 8 pieces of such a magnet were laminated and magnetized in a pulse magnetic field of 50 kOe. The maximum value of (BH)max of the resultant product was 25.6 MGOe.

Comparative Example 2

The same anisotropic magnet powder as that in Example 3 was heated while being compressed under the same conditions as those in Example 1 so as to obtain a bulk magnet with a density from 7.5 to 7.6 g/cm$^3$ having a diameter of 12 mm and a thickness of 1 mm. 8 pieces of such a bulk magnet were laminated and magnetized in a pulse magnetic field of 50 kOe. The value of (BH)max of the resultant product was 16.5 MGOe.

EXAMPLE 4

Isotropic magnet powder with a particle size from 50 to 250 μm having an alloy composition of $Nd_{13.5}Fe_{62.5}Co_{18}B_6$ and Ag-Cu-Zn-Cd-Ni powder having a liquidus temperature of approximately 620° C. were mixed in the V-type mixer at the weight ratio of 97:3 so as to prepare solder powder.

The solder powder and anisotropic magnet powder which has a different particle size from that of the solder powder and which has an alloy composition of $Nd_{13.9}Fe_{77.5}Co_{2.60}B_{6.00}$, were mixed in the V-type mixer at the ratio of 20:80. The resultant powder mixture was charged in the compacting mold formed of a sialon die and conductive TiN/sialon electrodes, and then compression-molded with a stress of 250 kgf/cm$^2$ in a pulse magnetic field of 25 kOe parallel to the compression axis so that the mixture was magnetically orientated in the compression direction.

Subsequently, the powder mixture was current-supplied in a pulsating manner (ON:250A, 50 ms/OFF:50 ms) for 10 seconds while being compressed with a stress of 250 kgf/cm$^2$. Then, the powder mixture was heated and further compressed while a current with a current density from 300 to 350 A/cm$^2$ for 20 to 30 seconds was directly supplied to the powder mixture, until it reached a maximum temperature from 700° to 780° C. As a result, a magnet with a density from 7.5 to 7.6 g/cm$^3$ having a diameter of 12 mm and a thickness of 1.3 mm was obtained. 4 pieces of such a magnet were laminated and magnetized in a pulse magnetic field of 50 kOe. The maximum value of (BH)max of the resultant product was 26 MGOe.

Comparative Example 3

An epoxy resin was mixed with the same anisotropic magnet powder as that in Example 4 at the ratio of 2:98. The resultant powder mixture was charged in the compacting mold and compression-molded with a stress of 8000 kgf/cm$^2$ in a pulse magnetic field of 25 kOe parallel to the compression axis so that the mixture was magnetically orientated in the compression direction. Subsequently, the powder mixture was demagnetized by an electric current. It was heated for 1 h at a temperature of 120° C. so as to cure the epoxy resin and thus to obtain a magnet with a density from 5.9 to 6.3 g/cm$^3$ having a diameter of 12 mm and a thickness 1.3 mm. 8 pieces of such a magnet. were laminated and magnetized in a pulse magnetic field of 50 kOe. The maximum value of (BH)max of the resultant product measured a was 15.2 MGOe.

Figure 2:
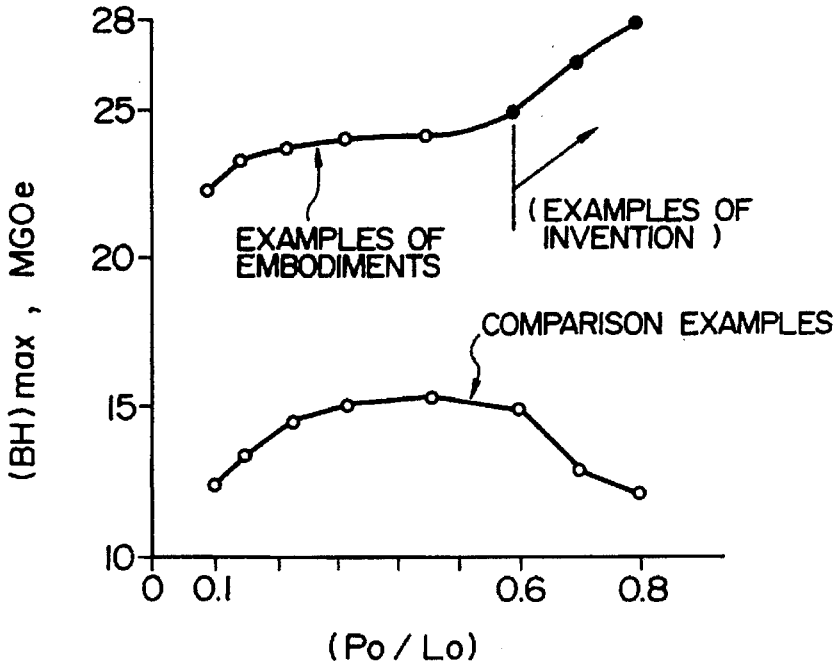
FIG. 2 is a graph showing the relationship between the (BH)max and the ratio (Po/Lo) of the average particle size (Po) of the anisotropic magnet powder to the size (Lo) of the magnet as measured in the magnetical orientation direction.

FIG. 2 shows the relationship between the (BH) max of the magnets obtained in Example 4 and the Comparative Example 3 after being magnetized at a pulse magnetic field of 50 kOe and the ratio (Po/Lo) of the average particle size Po of the anisotropic magnet powders of the magnets to the size Lo (thickness) of the magnet as measured in the orientation direction.

As in Comparative Example 3, the anisotropic magnet powder is compressed at room temperature so as to fix the magnet by a different kind of material such as a resin. Thus, the (BH) max of the resultant magnet is at most 15.2 MGOe.

On the other hand, as in Example 4, in a case where solder powder containing isotropic magnet powder as a main constituent thereof is used together with the anisotropic magnet powder so as to obtain the powder mixture, the molten solder improves slip properties of the anisotropic magnet powder when being moved, and the isotropic magnet powder effectively minimizes the disturbance of the magnetic orientation of the anisotropic magnet powder. Thus, the (BH)max of the resultant magnet is improved to be 22 MGOe or higher.

In particular, when the ratio (Po/Lo) in Example 4 exceeds 0.6, the relative movement of the anisotropic magnet powder becomes small, thus further minimizing the disturbance of the orientation to thereby obtain a higher (BH) max magnet.

As will be clearly understood from the foregoing description, the present invention offers the following advantages.

When the anisotropic magnet powder is fixed so as to produce a magnet, the powder mixture obtained by adding to the anisotropic powder a solder powder containing isotropic magnet powder as a main constituent thereof is magnetically orientated in a magnetic field and heated by an electric current while being compressed.

The solder powder first improves slip properties of the anisotropic magnet powder when being moved, and then, the isotropic magnet powder minimizes the disturbance of the orientation which disturbance occurs due to excessive densitication of the anisotropic magnet powder. Thus, the (BH) max of the magnet in which the magnet powder is fixed by a different kind of material can be improved.

Among the (BH)max of magnets in which anisotropic magnet powders are fixed by different kinds of materials, the above (BH)max is extremely high, and far higher than the (BH)max of magnets in which isotropic magnet powders are fixed by different kinds of materials. Further, since 5 to 50 weight % isotropic magnet powder, which is processed more simply than anisotropic magnet powder, is used, the present invention is advantageous from an economical point of view as well as obtaining a high value of (BH)max.

What is claimed is:

1. A process for producing a Nd-Fe-B magnet in which a content of anisotropic Nd-Fe-B magnet powder is from 95 to 50% by weight, said process comprising the steps of:

charging a powder mixture in a compacting mold, said powder mixture comprising said anisotropic Nd-Fe-B magnet powder and a powder containing a mixture of isotropic Nd-Fe-B magnet powder and solder powder which softens or melts when said solder powder is compressively heated;

magnetically orientating said powder mixture in a cavity in a magnetic field; and compressing and Joule heating the orientated powder mixture so that said powder mixture is fixed to thereby obtain said magnet.

2. A process as set forth in claim 1, wherein said step of compressing and Joule heating comprises supplying a pulsating current to said orientated powder mixture.

3. A process as set forth in claim 1, wherein said isotropic Nd-Fe-B magnet powder is a main constituent of said mixture of isotropic Nd-Fe-B magnet powder and solder powder.

4. A process as set forth in claim 3, wherein said isotropic Nd-Fe-B magnet powder is 97% by weight of said mixture of isotropic Nd-Fe-B magnet powder and solder powder.

5. A process as set forth in claim 4, wherein said isotropic Nd-Fe-B magnet powder has an alloy composition of $Nd_{13.5}Fe_{62.5}Co_{18}B_6$.

6. A process as set forth in claim 5, wherein said solder powder comprises Ag-Cu-Zn-Cd-Ni powder.

7. A process as set forth in claim 1, wherein said isotropic Nd-Fe-B magnet powder has an alloy composition of $Nd_{13.5}Fe_{62.5}Co_{18}B_6$.

8. A process as set forth in claim 7, wherein said solder powder comprises Ag-Cu-Zn-Cd-Ni powder.

* * * * *